US005363114A

United States Patent [19]

Shoemaker

[11] Patent Number: 5,363,114

[45] Date of Patent: Nov. 8, 1994

[54] PLANAR SERPENTINE ANTENNAS

[76] Inventor: Kevin O. Shoemaker, 1410 Garfield Ct., Louisville, Colo. 80027

[21] Appl. No.: 873,724

[22] Filed: Apr. 27, 1992

Related U.S. Application Data

[63] Continuation of Ser. No. 471,858, Jan. 29, 1990, abandoned.

[51] Int. Cl.[5] ..... H01Q 1/38; H01Q 9/42

[52] U.S. Cl. ..... 343/828; 343/830; 343/713; 343/906

[58] Field of Search ..... 343/803, 804, 806, 828, 343/829, 830, 846, 895, 792.5, 713, 906; H01Q 1/32, 1/38, 9/38, 9/42

[56] References Cited

U.S. PATENT DOCUMENTS

| | | | |
|---|---|---|---|
| 3,414,902 | 12/1968 | Shaw | 343/713 |
| 3,646,561 | 2/1972 | Clarke | 343/713 |
| 4,757,322 | 7/1988 | Yokogawa et al. | 343/713 |

FOREIGN PATENT DOCUMENTS

| | | | |
|---|---|---|---|
| 446869 | 2/1948 | Canada | 343/806 |
| 2336320 | 2/1975 | Germany | 343/713 |
| 62-31203 | 2/1987 | Japan | 343/713 |

*Primary Examiner*—Michael C. Wimer

*Attorney, Agent, or Firm*—Fields, Lewis, Pittenger & Rost

[57] ABSTRACT

Planar serpentine antennas disclosed include a generally flat, non-conductive carrier layer and a generally flat radiator of a preselected length and arranged in a generally serpentine pattern that is secured to a surface of the carrier layer. One form of the antenna disclosed that is particularly suited for vehicle transceivers and mounting on a vehicle window in a stick-on fashion has a series of change of direction points characterized by a succession of right angle turns and back folds to obtain substantially the greatest length in the smallest surface area. Another form of the antennas disclosed that are particularly suited for AM/FM radios, stereos, etc. have a sinuous pattern with radiator sections in parallel spaced relation to one another and further are connected at opposite ends in curved back folds. At least one and sometimes a pair of flat ground conductors are secured to a surface of the carrier layer in the same manner as the radiator to optimize the impedance match between a connecting cable and the radiator.

8 Claims, 4 Drawing Sheets

PLANAR SERPENTINE ANTENNAS

This application is a continuation of application Ser. No. 471,858, filed Jan. 29, 1990, abandoned.

TECHNICAL FIELD

This invention relates to novel and improved planar antennas.

BACKGROUND ART

Prior known generally flat or planar antennas having radiators arranged or extending in a generally spiral configuration are commonly referred to as equiangular spiral antennas. The equiangular spiral is one geometrical configuration whose surface is described by angles. In this category, the planar spiral has a single spiral, two spiral and multiple spiral planar radiators. A planar cavity-backed spiral antenna and a cavity-backed logarithmic spiral antennas also are presently in use. Another known planar antenna is identified as the sinuous antenna. These planar antennas have a center feed as distinguished from an end feed.

DISCLOSURE OF INVENTION

Planar serpentine antennas disclosed have a non-conductive, flexible carrier layer, preferably a MYLAR film, on which there is secured a flat radiator of a preselected length arranged in a generally serpentine pattern and having a feed end section at one end. A pair of flat ground conductors are also secured to the carrier layer. Each radiator has a series of change of direction points forming electric discontinuities to provide a series of connected radiator sections. One form of antenna disclosed has a series of alternating back folds and right angle turns. Another form disclosed has straight radiator sections arranged side by side and connected at opposite ends at curved back fold turns arranged in a generally sinuous pattern.

BRIEF DESCRIPTION OF THE DRAWINGS

Details of this invention are described in connection with the accompanying drawings which like parts bear similar reference numerals in which.

DETAILED DESCRIPTION

Figure 1:
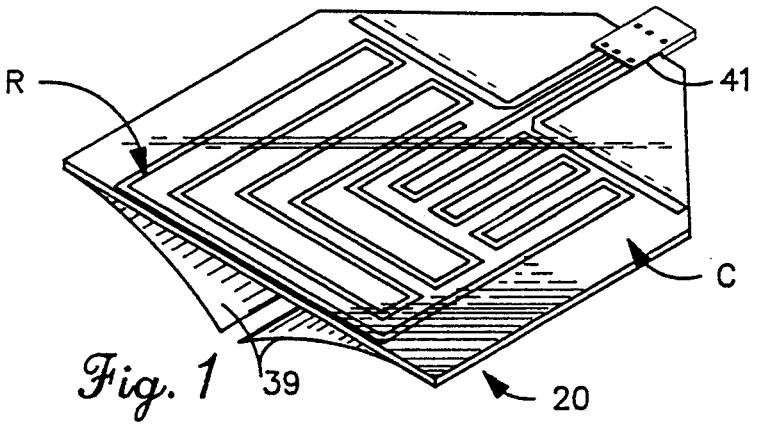
FIG. 1 is a perspective view of a planar serpentine antenna embodying features of the present invention with cover sheets shown partially removed.
Figure 3:
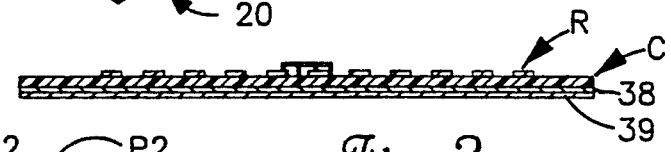
FIG. 3 is a sectional view taken along line 3—3 of FIG. 2 with thicknesses exaggerated for purposes of illustration.

The formulas for determining the length of the radiator of an antenna for the present invention are:

$$\text{Wave length } (\gamma) = \frac{300{,}000{,}000}{f(\text{hz})}$$

$$L \text{ (feet)} = \frac{492}{f(\text{Mhz})}$$

Other pertinent wavelengths are:

$\frac{\gamma}{2}$ half wavelength $\frac{\gamma}{4}$ quarter wavelength

To shorten the radiator of quarter wavelength antennas inductors or inductor/capacitor combinations are added. Antennas made according to the present invention can be made to resonate across a very wide frequency range as from about 1 Mhz to 2 Ghz.

Referring now to FIGS. 1–5 there is shown a planar serpentine antenna 20 embodying features of the present invention. The antenna shown has a generally flat or substantially planar, generally rectangular, flexible, non-conductive carrier layer C. The term "generally flat or substantially planar" as used herein to define the antenna and the carrier layer is intended to refer to both straight and curved planar surfaces. The antenna and carrier layer is flexible so it may conform to the shape of many different surfaces on which an antenna may be mounted so the antenna may also be referred to as conformal to a supporting surface.

An example of a flexible sheet material found suitable for use as carrier layer C is as follows:

| Mylar | |
|---|---|
| Dielectric Constant @ $10^6$ hz | 2.3–2.6 |
| Dissipation Factor @ $10^6$ hz | .01–.03 |
| Water Absorption, %, 1/16" | .2–.4 |
| Thickness | .001–.005 in. |
| | .003 in. preferred |

A thin, flat radiator R is secured to one surface of the carrier layer C. This radiator R has opposite ends herein designated for reference purposes as a first end 21 and a second end 22. The radiator has an end section 23 at the first end 21 that makes it suitable for connecting with a connector portion of a plug-in connector. A length of non-radiating section 24 is shown between an end section 23 and a straight first energy radiating radiator section 1 discussed hereinafter. The non-radiating section 24 shown has six relatively short, parallel, spaced, straight sections with back folds at the ends and arranged in a sinuous pattern. The end section 23 is wider than section 24 and the radiator sections 1, etc. so there is a double-sided bevel or taper at 29. Section 24 is for providing a longer total length for the radiator and for phase and is not intended for use as an energy radiating section. The radiator R shown has a total length that is resonant for a particular selected frequency.

The serpentine pattern of the radiator R shown in FIGS. 1–4 can generally be described as having a series of turns or change of direction points along the length thereof with each turn or change of direction point forming an electric discontinuity to provide a series of eleven connected energy radiating radiator sections designated by numerals 1–11. In particular, with reference to FIG. 2 the antenna shown has a straight first radiator section 1, first right angle turn or change of direction point P1, a straight second radiator section 2 extending at right angles to section 1, a second right angle turn or change of direction point P2, a straight third radiator section 3. These first three sections are an outer group which form three sides of the outer perimeter of the serpentine pattern of the radiator R.

Proceeding toward the second end 22 the radiator R further has an inner group of radiator sections that begin with back fold F toward the inside of the outer perimeter formed by two right angle change of direction points P3 and P4 with a straight fourth radiator section 4 extending parallel to and spaced from the third radiator section 4. There are a succession of alternating back folds, straight radiator sections and right angle turns arranged so there are sixth, seventh, eighth and ninth radiator sections 6, 7, 8 and 9 which are repeats of the second through fifth radiator sections but are shorter in length. A tenth radiator section 10 repeats the sixth radiator section 6 but is also shorter. The last radiator section 11 extends parallel to and in an opposite direction from the eighth radiator section 8 and extends to the second end 22.

This pattern for radiator R may be further characterized as an inner group of radiator sections having a succession of two inside patterns of similar shape with the second of the succession being smaller in size than the first. Each of the two inside patterns includes, in succession, a back fold, right angle turn and back fold with these two back folds being disposed at right angles to one another.

There is further provided a pair of identically shaped, generally flat ground conductors 25 and 26 secured to the carrier layer. The ground conductors 25 and 26 have a selected length and extend generally along one side of and are spaced from the radiator R and extend in opposite directions. The purpose of these ground conductors is to optimize the impedance match between a connecting cable and the radiator R. Ground conductor 25 has a first end 27 and a second end 28. Ground conductor 26 has a first end 31 and a second end 32. Ground conductor 25 makes a right angle turn to provide an end section 34 at the first end 27. Similarly, ground conductor 26 makes a right angle turn to provide an end section 35 at the first end 31. A miter or angled edge 36 is provided at the outer corner of each of the turns in the ground conductors.

The radiator R and each of the ground conductors 25 and 26 shown are in the form of a single integral conductive strip. A preferred material for each is copper dipped in a tin immersion to prevent corrosion. One procedure known as a photolithographic process may be used which involves having a conductive sheet bonded to a carrier layer and remove the conductive sheet from the carrier layer except for the radiator and ground conductors. Another process would involve vacuum deposition of the conductive metal onto the carrier layer. In both instances the conductive sheet is bonded to or becomes an integral part of the carrier layer and flexes with the carrier layer. A preferred thickness of the radiator and ground conductors as above described is about 0.0015 inches.

Figure 4:
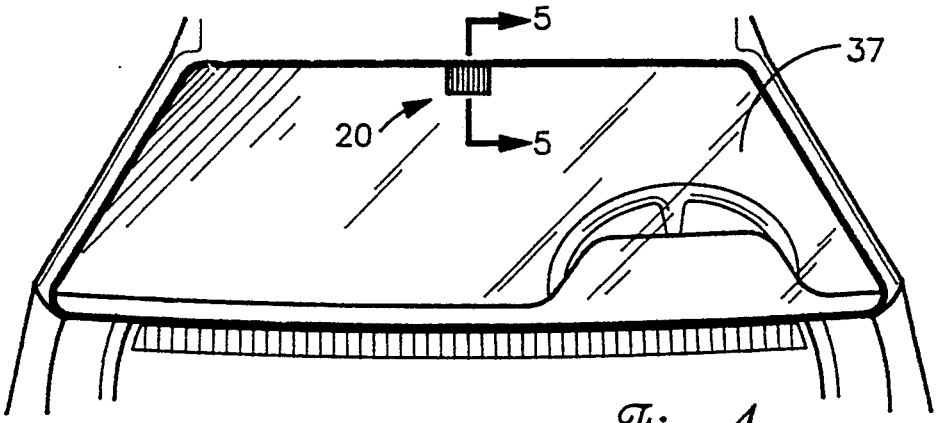
FIG. 4 is a front elevational view of the antenna shown in FIG. 1 installed on the inside and at the top of the front windshield of a motor vehicle for use with a transceiver installed in the vehicle.
Figure 6:
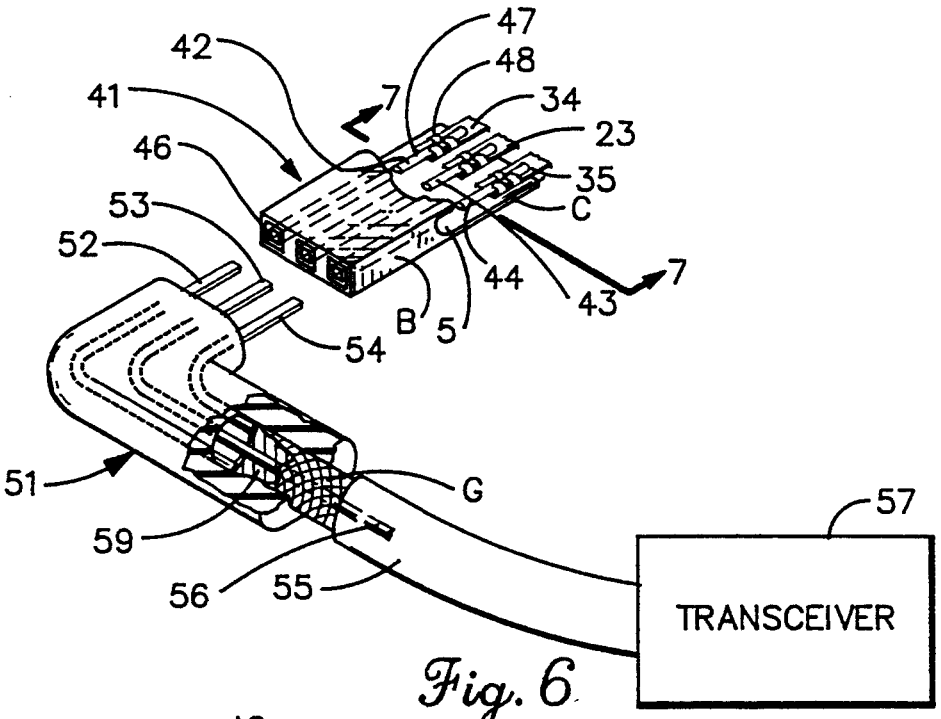
FIG. 6 is a perspective view of male and female connector portions for the antenna shown in FIG. 1 with outer portions broken away to show interior construction.
Figure 7:
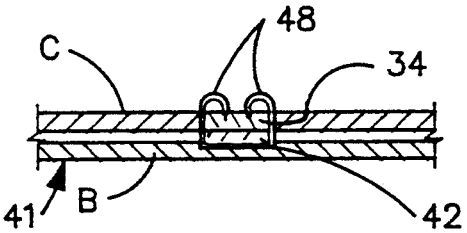
FIG. 7 is a sectional view taken along line 7—7 of FIG. 6.

The antenna 20 shown in FIGS. 1–6 has means for securing the carrier layer C to a supporting surface and in particular to the inside of a vehicle windshield 37 as shown in FIG. 4. To this end in the antenna shown there is provided an adhesive coating 38 on one surface of the carrier layer opposite the surface which supports the radiator R and this adhesive coating before installation is normally covered by a pair of cover sheets 39 which are removed when the antenna is installed. The antenna 20 may be characterized as a stick-on type device.

A female connector portion 41 of a plug-in connector is shown mounted on a tapered top end portion of the carrier layer C. This connector portion 41 has three separate connecting elements 42, 43 and 44 mounted in a rectangular plastic body B and arranged in a parallel spaced relation to one another electrically connected at one end to each of the above-described end sections 34, 23 and 35, respectively, of the above described antenna 20. Each of these connecting elements 42, 43 and 44 is identical in construction and includes a tubular socket section 46 at one end and a thin, flat lead section 47 at the other end. Each lead section 47 is secured to an associated end section of the antenna. Each lead section 47 shown has three teeth 48 that extend up from the side edges thereof. In the assembly the coupling body has a slot S which enables the end portion to slide thereinto locating each end section in an overlapping relation to an associated lead end section. The teeth pierce the carrier layer and extend up through the carrier layer C. The teeth are bent over in a crimping action to fasten each connecting element 42, 43 and 44 to the carrier layer C and at the same time electrically connect each end section 34, 23 and 35 to the associated connecting element 42, 43 and 44, respectively. An alternative to the crimp is to solder the connections.

Figure 5:
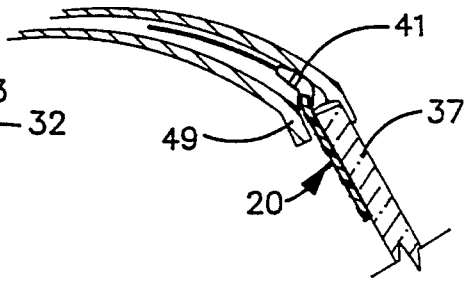
FIG. 5 is a sectional view taken along line 5—5 of FIG. 4.

In the installation on the motor vehicle shown, the female connector portion 41 and the tapered supporting end portion of the carrier layer C extend under the headliner 49 of the vehicle as seen in FIG. 5 with the radiator R and ground conductors 25 and 26 being affixed to the inside of the windshield and beyond the headliner so as to be exposed. The dashed line in FIG. 1 shows the approximate locator of the end of the headliner. With the radiator and ground conductors then affixed to the inside of the windshield, the windshield is used as part of the supporting substrate for the antenna. The dielectric constant K of a typical windshield is more than air and about 2 to 7.

A mating male connector portion 51 has three pin connecting elements 52, 53 and 54 that insert into associated tubular socket sections of connecting elements 42, 43 and 44, respectively. The other ends of pin connecting elements 52 and 54 connect as by soldering to a circular ground G and element 53 connects to the center conductor 56 of a coaxial cable 55 through which electric signals are transmitted. A non-conductive core 59 surrounds conductor 56 and the ground G fits over this core. The opposite end of the coaxial cable connects to a transceiver 57 carried at a suitable location on the motor vehicle such as in the trunk.

Figure 2:
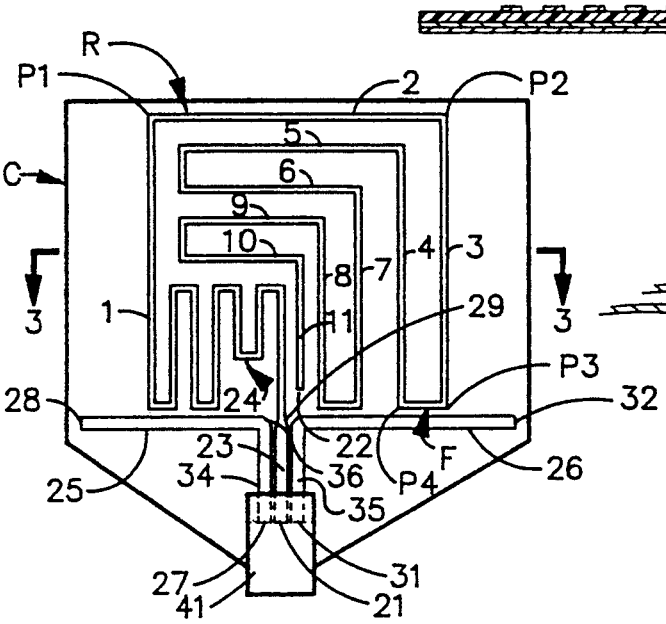
FIG. 2 is a top plan view of the antenna shown in FIG. 1.
Figure 8:
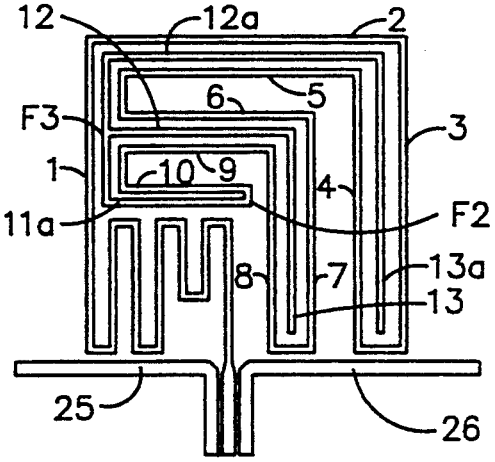
FIG. 8 is a top plan view of yet another radiator configuration according to the present invention.

Referring now to FIG. 8 a modified serpentine pattern for the radiator shown is similar to that of FIG. 2 through radiator section 10 and further has a back fold F2 and an eleventh radiator section 11*a* extending parallel to tenth radiator section 10. The radiator then has a back fold F3 and forks or divides into two end portions arranged generally parallel to one another. One end portion consists of a first twelfth radiator section 12 extending from the middle of fold F3 and between sections 6 and 9 and a first thirteenth section 13 extending between sections 7 and 8. The other end portion consists of second twelfth radiator section 12*a* extends from the end of fold F3 between sections 2 and 5 and a second thirteenth section 13*a* between sections 3 and 4. Modifications from this form shown in FIG. 8 would include versions that eliminate one of the end portions.

Figure 9:
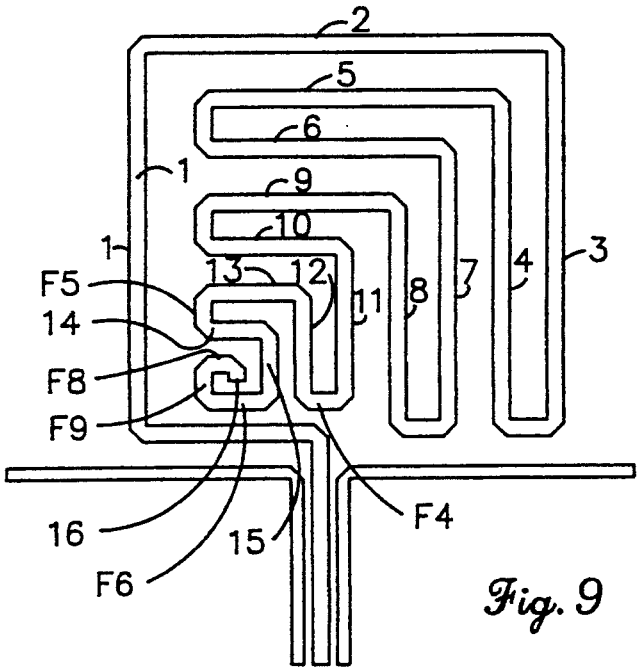
FIG. 9 is a top plan view of yet another radiator configuration according to the present invention.

Referring now to FIG. 9 the serpentine pattern shown is similar to FIG. 1 but has a succession of three inside patterns of a similar shape with each successive inside pattern being smaller in size. Each of the three inside patterns includes in succession, a back fold, right angle turn and back fold with the two back folds being disposed at right angles to one another. This form has a back fold F4 at the lower end of the eleventh section 11 followed by a twelfth radiator section 12, right angle turn, thirteenth radiator section 13, back fold F5, fourteenth radiator section 14, right angle turn, fifteenth radiator section 15. There is an end portion with a succession of folds F6, F7 and F8 with a very short end section 16. It is further noted that inside sections 4, 7, 11 and 15 are parallel to one another and successively shorter in length. Similarly inside sections 5, 9 and 13 are parallel to one another and succeedingly shorter in length as are sections 6, 10 and 14. Each back fold and right angle turn has a mitered edge 45. The radiator of this form is wider than of the previously described antennas and an alternative embodiment would be of the same pattern shape but of a thickness similar to FIG. 2.

Figure 10:
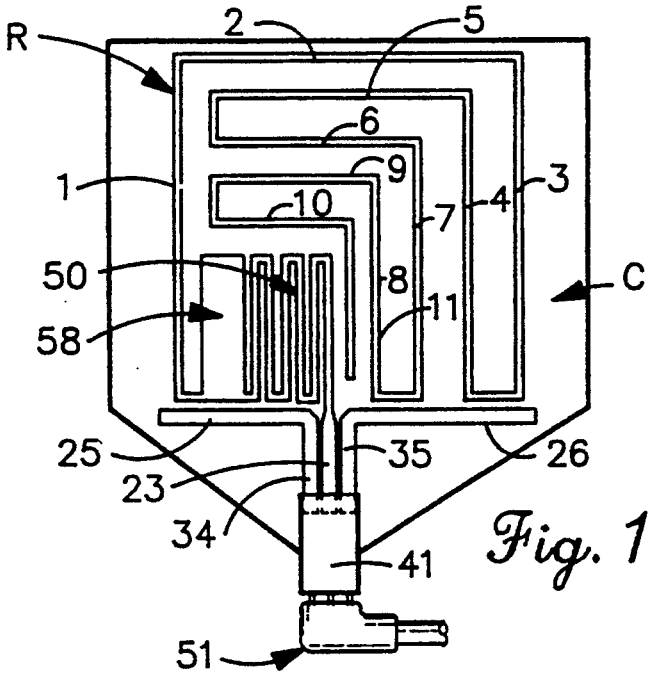
FIG. 10 is a top plan view of a tuned serpentine antenna embodying features of the present invention.
Figure 11:
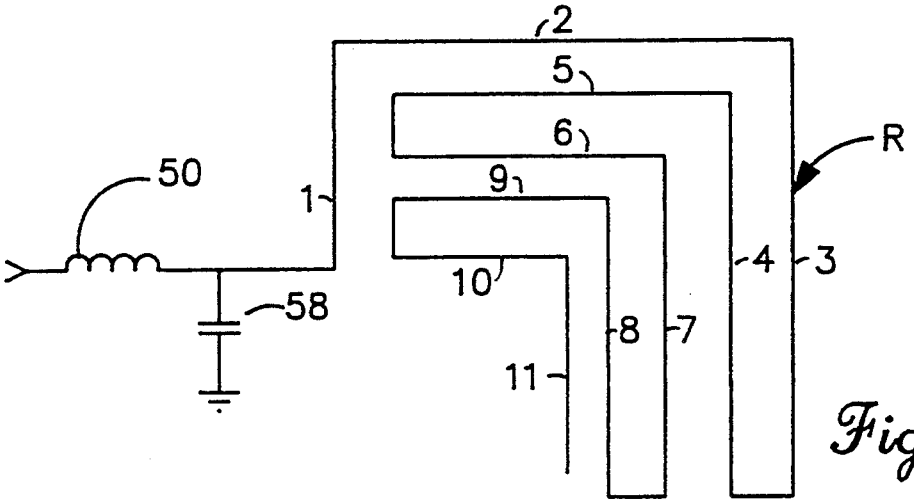
FIG. 11 is an electric schematic diagram of the antenna shown in FIG. 10.

Referring now to FIG. 10 there is shown a tuned serpentine antenna wherein between end section 23 of the radiator and the first straight radiator section 1 there is a series of six parallel, spaced, straight sections with curved back folds arranged in a sinuous pattern which form an inductor 50 together with a wider rectangular conductor section that forms a capacitor 58. The electric circuit for the antenna of FIG. 10 is shown in FIG. 11 which includes the inductor 50 connected in series with the radiator R. The capacitor 58 is connected in parallel with the radiator and is also electrically connected to the inductor 50. The capacitor 58 is connected between the common connector of the inductor and radiator and ground.

Figure 12:
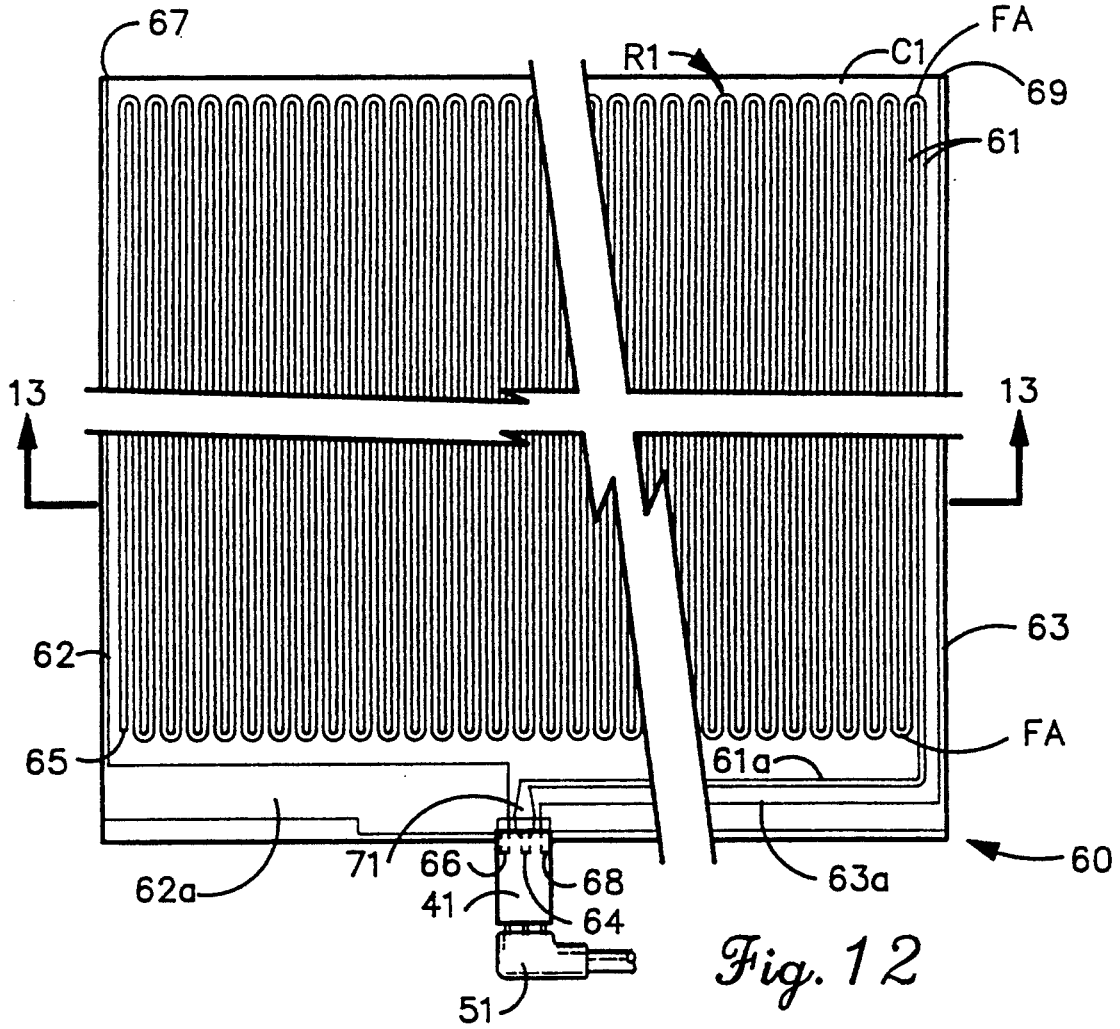
FIG. 12 is a top plan view of another embodiment of a planar serpentine antenna embodying features of the present invention.
Figure 13:
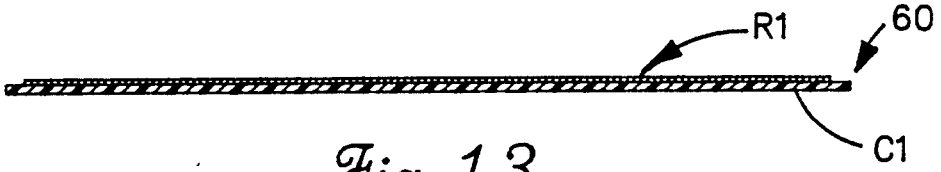
FIG. 13 is a sectional view taken along lines 13—13 of FIG. 12.

Referring now to FIGS. 12 and 13 there is shown another embodiment of a planar serpentine antenna 60 according to the present invention wherein there is provided a generally flat, flexible carrier layer C1 on which there is supported a radiator R1 having a first end 64 and a second end 65. This radiator R1 is generally sinuous having a plurality of elongated radiator sections 61 arranged parallel and spaced from one another and connected at opposite ends at curved, back fold turns FA. The radiator R has a right angle turn to form an end section 61*a* and makes yet a further right angle turn to form end section 71 at end 64.

A pair of flat ground conductors 62 and 63 on the carrier layer C1 extend along opposite sides of the perimeter of the radiator R1. Ground conductor 62 has a first end 66 and a second end 67. Ground conductor 63 has a first end 68 and a second end 69. Ground conductor 62 has a right angle turn to form an end section 62*a* at end 66 and ground conductor 63 makes a right angle turn to form an end section 63*a* at end 68.

This antenna has two resonant frequencies. One based on the length of each radiator section 61 and the other based on the total length between ends 64 and 65. This antenna having radiator sections 30 inches in length and a total length of 3000 inches would have $\lambda/4$ at 100 Mhz (Fm) and $\lambda/4$ at 1 Mhz (Am).

Figure 14:
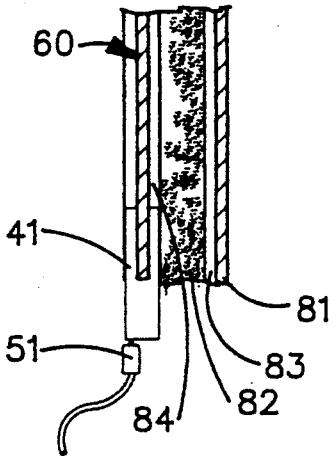
FIG. 14 is a sectional view showing the antenna of FIGS. 12 and 13 mounted on a supporting surface.

Referring now to FIG. 14 there is shown the antenna 60 above described that has been mounted on a supporting wall 81. Wall 81 may be the roof of a motor vehicle which has AM/FM radio to which the antenna is connected or may be a vertical wall in a home, office or the like in which the antenna may be connected to a stereo system. A preferred location for this antenna in a motor vehicle is at a central location in the top of the vehicle body under the headliner so it is not viewable by the occupant. In each case, there is provided a foam layer 82 that is secured to the wall 81 by an adhesive layer 83 and the antenna 60 is secured to the foam layer by an adhesive layer 84.

Figure 15:
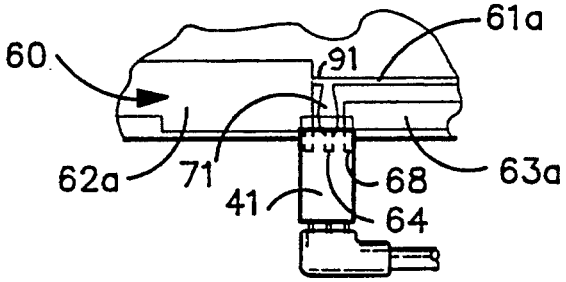
FIG. 15 is a fragmentary top plan view of a modification of the connections for the antenna shown in FIGS. 12 and 13 to change one of the ground conductors to a second radiator.

A modified form of antenna shown in FIG. 15 is identical in construction to that shown in FIGS. 12 and 13 but has an added conductor segment 91 that electrically connects end section 62*a* of ground conductor 62 to the end section 61 of radiator R1 so that conductor 62 becomes a second radiator that is connected in parallel with radiator R1 at the feed end. Conductor 63 then becomes the only ground conductor. It is further understood that in the alternative the segment could connect to conductor 63 using it as a radiator and having conductor 62 as the only ground conductor.

A female connector portion 41 found suitable is a center flat flex connector model 70430 series female part No. 15-38-8038 manufactured by Molex. A male connector portion 51 found suitable is a pin strip right angle three row connector part No. 929770-01-01 manufactured by 3M Company.

Illustrative examples of applications for the above antennas are:

Television; FM radio, AM radio; aircraft communication/navigation; police low band, police high band; RC airplanes; aircraft (air traffic control transponder); specialty police; remote instrumentation; cellular phone; and ham radio/shortwave.

In each of the above described antennas the radiator sections are arranged so that at least two of the radiator sections are connected to one another and are arranged perpendicular to one another to radiate energy in an omnidirectional pattern. Further these two connected radiator sections at right angles provide currents in alignment with the E vector are those corresponding to horizontal and vertical polarization. Polarization is the direction of the E field vector.

Although the present invention has been described with a certain degree of particularity, it is understood that the present disclosure has been made by way of example and that changes in details of structure may be made without departing from the spirit thereof.

What is claimed is:

1. A planar serpentine antenna comprising:

a substantially planar carrier layer, a substantially planar radiator of a preselected length secured to said carrier layer, said radiator extending in a substantially serpentine pattern and having a feed end and an open end, said radiator having a series of change of direction points along the length thereof with each said change of direction point forming an electric discontinuity to provide more than one connected radiator section along the length of said radiator, said radiator providing at least two different resonant frequencies, said radiator sections being arranged so that at least two of said sections are connected to one another and are arranged substantially perpendicular to one another to radiate energy in an omnidirectional pattern and so that the currents in alignment with the E vector are those corresponding to horizontal and vertical polarizations, and a pair of substantially planar ground conductors of a preselected length secured to said carrier layer for optimizing the impedance match between a connecting cable and said radiator, said pair of ground conductors being arranged in spaced relation to the outer periphery of said radiator, said ground conductors extending in opposite directions away from one another and having turns to form adjacent, parallel spaced end sections arranged for connecting to an electric connector portion, said pair of ground conductors being coplanar and do not extend outside the coplanar plane, said series of change of direction points including turns at selected angles and back folds, there being an outer group of three of said radiator sections connected at two right angle turns and an inner group of a plurality of said radiator sections having a succession of alternating back folds and right angle turns, said inner group being completely surrounded by said outer group so as to be located inside said outer group.

2. An antenna set forth in claim 1 wherein at least some of said inner group of radiator sections proceeding in a direction away from said feed end to said open end are shorter in length than the radiator sections in said outer group.

3. An antenna as set forth in claim 1 wherein said radiator divides into two end portions arranged generally parallel to one another, each said end portion having a right angle turn to form two radiator sections in each of said end portions.

4. An antenna as set forth in claim 1, wherein said radiator and ground conductors have end sections and further including a connector portion on said carrier layer, said connector portion having a separate connecting element electrically connected to each of said end sections, said connector portion being adapted to connect to a mating second connector portion connected to a cable.

5. An antenna as set forth in claim 4 wherein said cable is a coaxial cable having an inner center conductor, a non-conductive core surrounding said inner conductor and an outer ground member concentric with said inner center conductor.

6. An antenna as set forth in claim 1 wherein said radiator has an end section at said feed end, each of said ground conductors having end sections, the radiator end section being disposed between, spaced from, and coplanar with said end sections of said ground conductors.

7. A planar serpentine antenna comprising:

a substantially planar carrier layer, a substantially planar radiator of a preselected length secured to said carrier layer, said radiator extending in a substantially serpentine pattern and having a feed end and an open end, said radiator having a series of change of direction points along the length thereof with each said change of direction point forming an electric discontinuity to provide more than one connected radiator section along the length of said radiator, said radiator providing at least two different resonant frequencies, said radiator sections being arranged so that at least two of said sections are connected to one another and are arranged substantially perpendicular to one another to radiate energy in an omnidirectional pattern and so that the currents in alignment with the E vector are those corresponding to horizontal and vertical polarizations, and a pair of substantially planar ground conductors of a preselected length secured to said carrier layer for optimizing the impedance match between a connecting cable and said radiator, said pair of ground conductors being arranged in spaced relation to the outer periphery of said radiator, said ground conductors extending in opposite directions away from one another and having turns to form adjacent, parallel spaced end sections arranged for connecting to an electric connector portion, said pair of ground conductors being coplanar and do not extend outside the coplanar plane, there being an outer group of three radiator sections connected at two right angle turns and there being a succession of three inside groups, disposed within said outer group, said three inside groups being of a corresponding shape and being successively smaller toward the center of said carrier layer, each said inside group having a back fold, right angle turn, and back fold together with an end portion of three successive back folds and an end section.

8. An antenna as set forth in claim 7 wherein each back fold and right angle turn has an outside mitered edge.

* * * * *